United States Patent [19]

Hebinck

[11] Patent Number: 4,823,534

[45] Date of Patent: Apr. 25, 1989

[54] METHOD FOR CONSTRUCTING INSULATED FOAM HOMES

[76] Inventor: Carl L. Hebinck, 53 Highland Pl., Land O'Lakes, Fla. 34639

[21] Appl. No.: 156,903

[22] Filed: Feb. 17, 1988

[51] Int. Cl.[4] ..... E04B 1/16

[52] U.S. Cl. ..... 52/743; 52/309.12; 52/251

[58] Field of Search ..... 52/309.4–309.9, 52/309.12, 309.16, 309.17, 251, 259, 743, 740

[56] References Cited

U.S. PATENT DOCUMENTS

| | | | |
|---|---|---|---|
| 3,471,984 | 10/1969 | Hayes . | |
| 4,074,489 | 2/1978 | Eckel | 52/272 |
| 4,163,349 | 8/1979 | Smith | 52/241 |
| 4,251,578 | 2/1981 | Kaufmann | 428/53 |
| 4,512,126 | 4/1985 | Walston | 52/251 |
| 4,532,745 | 8/1985 | Kinard | 52/251 |
| 4,628,650 | 12/1986 | Parker | 52/265 |
| 4,641,468 | 2/1987 | Slater | 52/309.4 |
| 4,674,250 | 6/1987 | Altizer | 52/309.7 |
| 4,731,971 | 3/1988 | Terkl | 52/743 |

FOREIGN PATENT DOCUMENTS

| | | | |
|---|---|---|---|
| 2570738 | 3/1986 | France | 52/309.7 |

*Primary Examiner*—David A. Scherbel
*Assistant Examiner*—Caroline D. Dennison
*Attorney, Agent, or Firm*—Henderson & Sturm

[57] ABSTRACT

A method for forming building walls by starting with blocks of expanded polystyrene, for example in typical 4′×16′ lengths. Spaced apart vertical voids are formed in the polystyrene and a depression along the top of the block of polystyrene is provided for interconnection with the vertical voids to form concrete can be poured into the vertical voids to form vertical posts and concrete can be poured into the horizontal depression to form horizontal beams, thereby forming wall sections which are well-insulated because of the high R value of the expanded polystyrene and which have great rigidity because of the concrete posts and beams. An insulated roof structure is formed having air passageways formed over the insulation and leading to a roof top ventilator.

5 Claims, 4 Drawing Sheets

METHOD FOR CONSTRUCTING INSULATED FOAM HOMES

TECHNICAL FIELD

The present invention relates generally to a method of constructing homes or the like, and more particularly to a method for forming walls and roofs of expanded polystyrene having concrete posts and beams therein and uniquely joined to produce a super energy edifice.

BACKGROUND ART

The problem of constructing buildings such as homes which are well insulated is a long-standing one, although the demand for such construction has increased dramatically since the costs of energy for heating buildings and homes has increased significantly over the last decade or two. A major problem seems to be that structural materials having a high degree of rigidity and strength by their very nature are also quite dense and tend to be, for that reason, quite good conductors of heat. Consequently, when homes or other buildings are constructed of normal building materials, chosen because of their rigidity and strength, the heat from the home is readily radiated through such structural members and to the outside air. For that reason, materials having a higher R value tend to have less strength and more air spaces between the parts thereof.

One excellent insulating material is expanded polystyrene which can be formed in rigid blocks, but its application and wall structure is somewhat limited because it does not have the strength of wood or concrete or the like. Consequently, there is a need for methods of constructing walls and roofs of materials having a high insulating R value, while at the same time having the necessary strength and rigidity.

DISCLOSURE OF THE INVENTION

The present invention relates generally to a method for forming building walls and roofs by starting with blocks of expanded polystyrene, for example in typical $4' \times 16'$ lengths. Spaced apart vertical voids are formed in the polystyrene and a depression along the top of the block of polystyrene is provided for interconnection with the vertical voids so that concrete can be poured into the vertical voids to form vertical posts and concrete can be poured into the horizontal depression to form horizontal beams, thereby forming wall sections which are well-insulated because of the high R value of the expanded polystyrene and which have great rigidity because of the concrete posts and beams.

An object of the present invention is to provide an improved wall and roof construction for buildings.

Another object of the present invention is to provide a method of forming walls and roofs which are super insulated and super strong.

Another object of the present invention is to provide a wall which is soundproof, economical, termite resistant, rot proof and simple to construct.

Another object of the invention is to provide a method of forming a wall of the aforementioned type which requires very little maintenance in addition to the other advantages listed above.

Other objects, advantages, and novel features of the present invention will become apparent from the detailed description of the invention when considered in conjunction with the accompanying drawings.

BEST MODE FOR CARRYING OUT THE INVENTION

Figure 1:
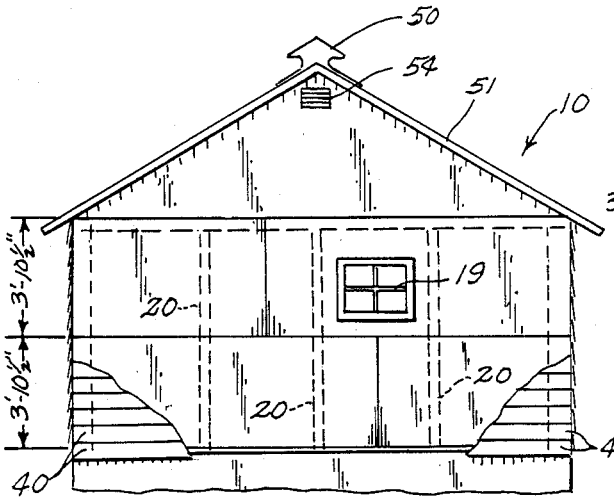
FIG. 1 is a side elevational view of a building constructed in accordance with the present invention.
Figure 7:
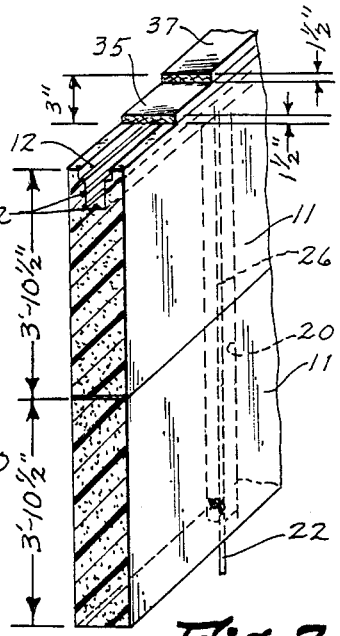
FIG. 7 is a partial perspective view similar to FIG. 2 but showing a foam gasket and a wooden board which fits on top of the foam wall.

Referring now to the drawings wherein like reference numerals designate identical or corresponding parts throughout the several views, FIG. 1 shows a building (10) constructed by utilizing the method and apparatus of the present invention.

Figure 2:
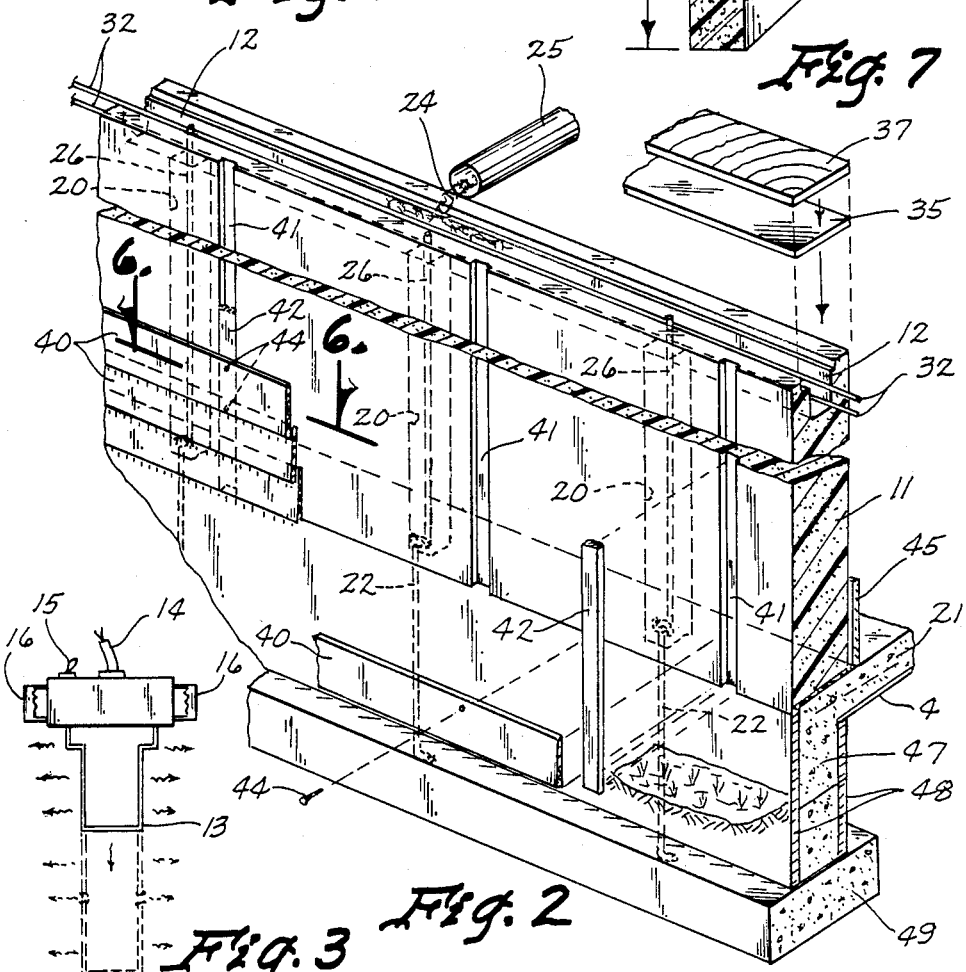
FIG. 2 is an exploded perspective view of a wall in the process of being constructed in accordance with the present invention.
Figure 3:
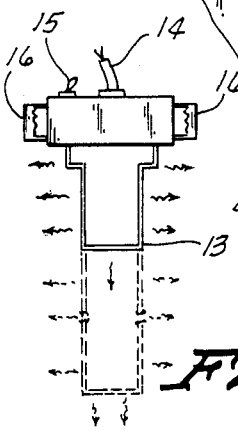
FIG. 3 is one of several electrically operated hot wire cutout jig mechanisms which could be used for cutting the depression in the top of the expanded polystyrene rigid block shown in FIG. 2.

FIG. 2 shows a standard $4' \times 16' \times 11\frac{1}{4}''$ block (11) of expanded polystyrene in a rigid form. The top polystyrene block (11) has a cutout depression (12) in the top thereof which can be preformed or formed on the site by the hot wire jig (13) shown in FIG. 3. The hot wire jig (13) includes an electrical cord (14), a switch (15), handles (16) and housing (17). Rigid wire section (18) is heated by resistance heating methods by sending electricity through the hot wire (18). Because the hot wire (18) is of the shape of the depression (12), the tool (13) can be utilized to cut the depression completely across the top of the polystyrene block (11), either on the building site or such depression can be preformed and shipped to the building site. Other shapes of wire (13) can be used if desired.

Similarly, vertical depressions (20) extend from the bottom of the depression (12) to the complete bottom of the polystyrene block (11).

If it is desired to cut a window like (19) in FIG. 1, then a hot wire jig of another type would be utilized to melt the polystyrene block (11) and remove the desired shape. It will be appreciated that windows of many different shapes can readily be placed into a wall utilizing this construction.

Figure 4:
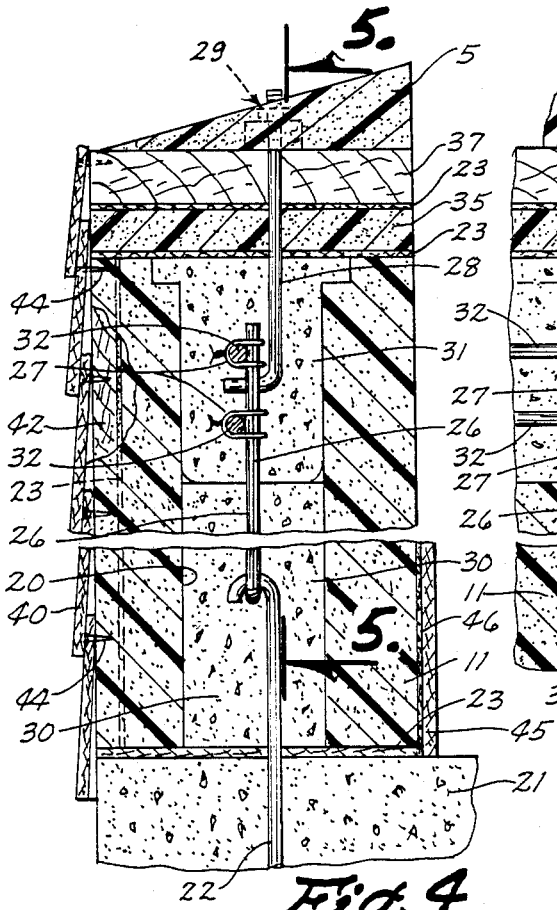
FIG. 4 is a cross sectional view through the wall after it is formed, which is shown in the process of being formed in FIG. 2.
Figure 5:
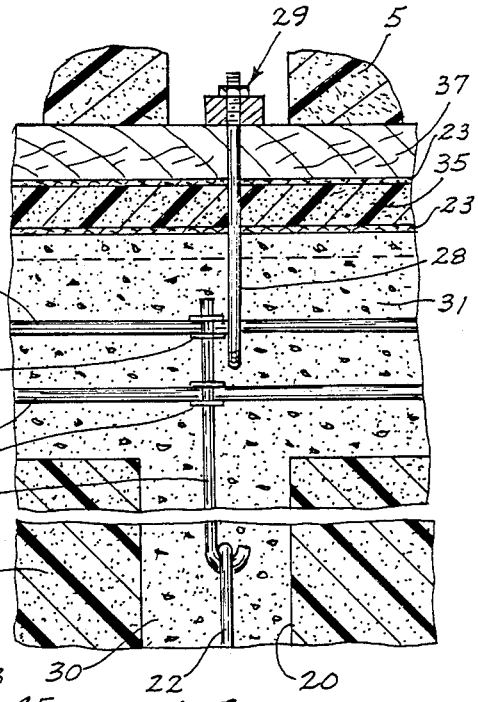
FIG. 5 is a cross sectional view taken along line 5—5 of FIG. 4.
Figure 6:
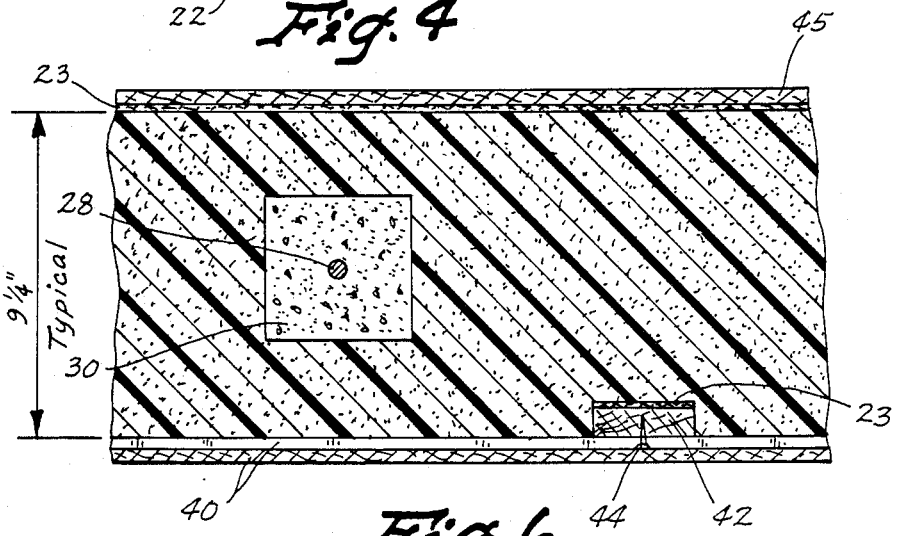
FIG. 6 is a cross sectional view taken along line 6—6 of FIG. 2.

Referring to FIG. 4, it is noted that a slab (21) of concrete is first poured with a short hooked reinforcing rod (22) placed therein. Slap (21) can be on top of a basement wall (47) poured between forms (48), resting on a concrete footing (49). Vapor barrier (4) is also provided. Once the concrete (21) has dried, an adhesive (23) is applied to a top portion of the concrete (21). The bottom polystyrene block (11) is then placed on the adhesive (23), before it is cured, to secure the bottom polystyrene block (11) in place on the slab. Then the top block (11), with the lentil cutout (12) is placed on the bottom block (11), aligning the holes (20) and inserting the long hooked rods (26) down into the hole hooking the slab hook (22) and tied above.

The rod (26) of FIG. 4 is connected to a pair of rods (32) by clips (27) extending around rods (32) and rod (26).

Rod (28) (FIG. 4) extends through holes in EPS foam gasket (35) and 2×10 inch wooden plate (37). Nut and washer assembly (29) connects to member (28) to hold gasket (35) and wooden plate (37) in place.

Pumped concrete (24), passing out of a hose (25) as shown in FIG. 2 is directed into the voids (20), until they are filled. The concrete is preferably 5,000 PSI concrete reinforced with ⅝" steel rods (22). The concrete (24) shown in FIG. 2 can be poured into the vertical voids (20) and also at the same time into the horizontal depression (12) so that the posts (30) and the horizontal beam (31) are integrally formed in one piece (monolithic) when the concrete dries. If it is desired to have more than one floor (story), then another or second set of tie-down reinforcing rods (22) can be placed in the position shown in FIG. 4 and the process repeated before the concrete of the horizontal posts (31) cures.

EPS foam (5) fills a wedge shaped area between the rafters and the top wooden plate (37).

Each of the three wall sections, one on top of the other as shown in FIG. 1 are essentially identical except that the center one has a window (19) placed in it. Furthermore, each of the sections are identically formed, one at a time, as one is formed on top of the one just previously formed.

If it is desired to place siding boards (40) on the exterior of the wall, as shown in FIGS. 1, 2 and 4, then vertical cutouts (41) are made in the exterior of the polystyrene block (11) at spaced intervals as shown in FIG. 2. These can be formed by a tool like the tool shown in FIG. 3, but with a wire (13) of a shape like cutout (41). Strips of wood (42) are then glued into the space cutouts (41) by use of adhesive (23). The siding (40) is then attached to the wood strips (42) by nails (44).

If desired, drywall (45) can be glued to the interior of the walls of polystyrene block (11), for example as shown in FIG. 2, care being taken to use adhesives compatible with the EPS foam.

The windows are aligned with wooden 2×12's and secured to adjacent posts and beams with threaded nuts and bolts. All cracks are sealed with foam sealant and are sanded. The blocks butt-joint together like cinder blocks and are secured in place with foam sealant or other adhesive.

A prefabricated roof is also provided of truss joints and wooden I-beam surface rafters. A radiant foil barrier is glued to the upper surface of the foam beams which are tightly inserted into the cavities of the rafters and placed on 24" centers. The foil deflects roof heat and carries it upward through a 1½" space and out a continuous ridge vent, thereby removing latent heat and prolonging the life of the shingles. Electrical wiring is placed in the 1½" gap between gypsum board on the underside of the rafters and the foam insulation. Gypsum board provides a fire barrier even though the polystyrene foam is fire retardant and non-toxic.

Figure 8:
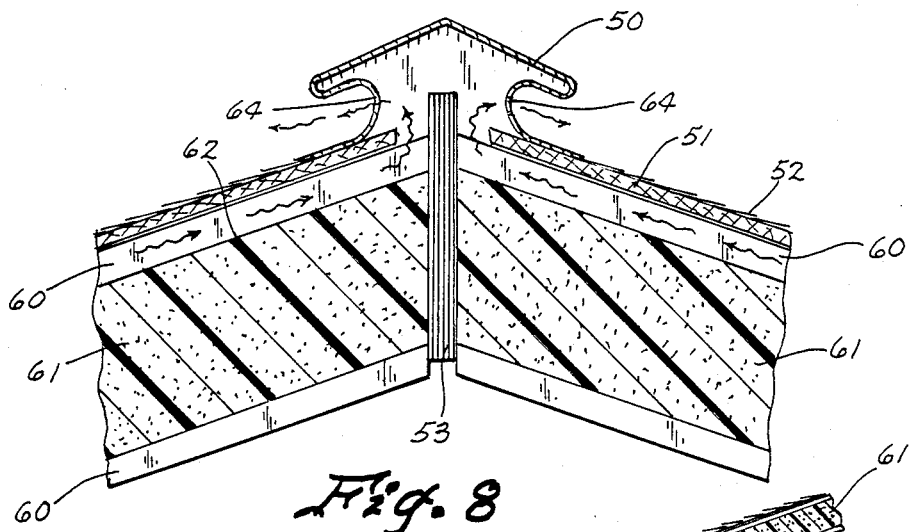
FIG. 8 is a cross sectional view through a top portion of the roof of FIG. 1.
Figure 9:
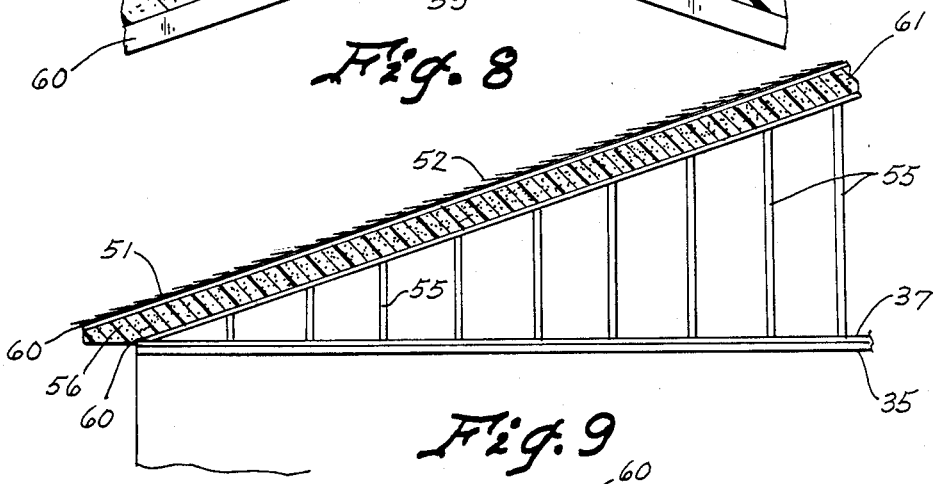
FIG. 9 is a cross sectional view through one side of the rafters of the FIG. 1 structure.

Referring to FIG. 8, it is noted that a ventilator (50) is shown attached at the top of the roof (51). Fiberglass shingles or other shingles or waterproofing over felt and plywood are shown at (52), although it will be understood that other types of waterproofing can be used.

A central wooden beam extends along the top peak of building roof (51) along the entire length thereof and has truss joist rafters (56) attached thereto at spaced intervals along the length thereof. These can be 2×12 wooden members, for example. Laminated wooden I-beam members (60) are connected to the plywood roof (51) on the top thereof, to wooden I-beam truss joist (56) on the bottom thereof and to members (60) on the bottom of members (56) which are connected to drywall (45) which is readily shown also in FIG. 10 extending up the vertical wall and then along under the roof as well. Rigid EPS foam (61), for example of 8⅞" thickness and having a radiant foil (62) on the top thereof is held in place by being sandwiched between the members (60) as shown in FIG. 11 and providing an air space between the plywood roof (51) and the radiant foil (62) and between the bottom of the foam (61) and the drywall (45).

Figure 10:
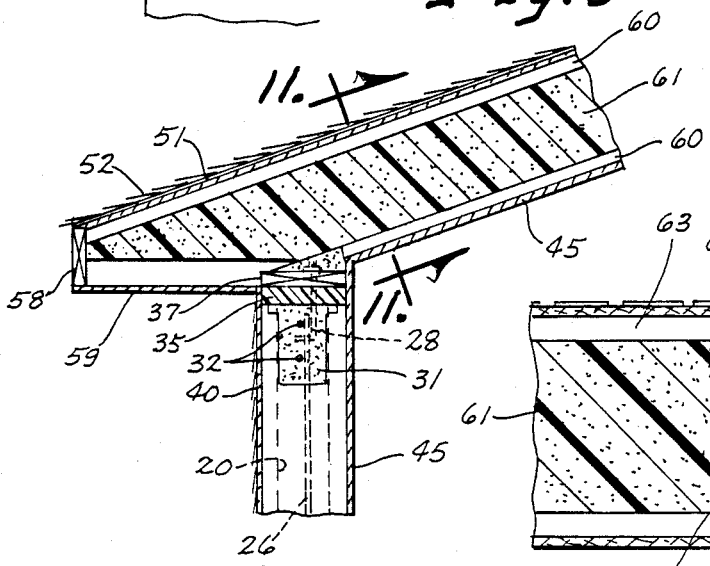
FIG. 10 is a cross sectional view through one edge of the roof and a top portion of the walls of the building of FIG. 1.
Figure 11:
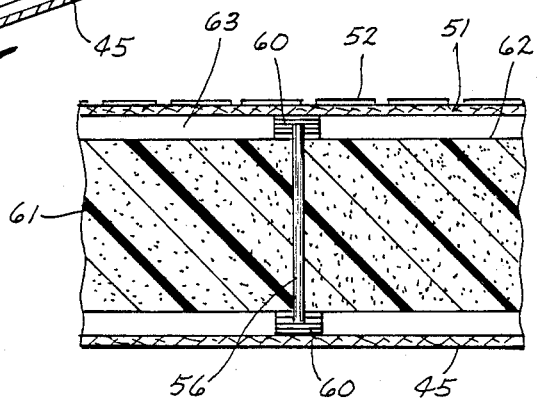
FIG. 11 is a cross sectional view taken along line 11—11 of FIG. 10.

A 2×8 wooden member (58) is shown in FIG. 10 and connects with the plywood (51) on the top thereof and with a plate (59) under the eaves of the house which also extends over to the siding (40). The EPS foam (61) can be of a R-50 roof system with a radiant foil thereon.

Figure 12:
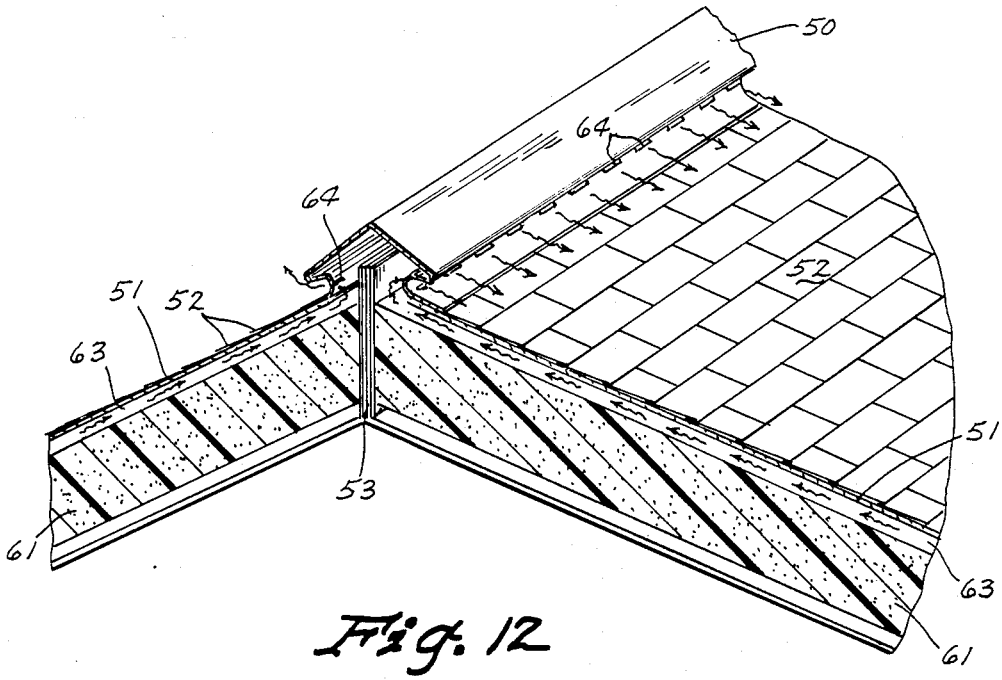
FIG. 12 is a partial perspective cross sectional view of a section of the roof.

Referring to FIG. 12, it is noted that heated air rises in the 1½" air space between the roof sheathing and the radiant foam on the EPS beams. This hot air will then exit out of rooftop continuous ridge vent (50) as is clearly shown in FIG. 12.

Accordingly, it will be appreciated that the method and apparatus shown in the drawings and just described above do indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A method of constructing walls for buildings consisting of:

providing a form in the ground;

pouring concrete into said form;

placing substantially vertically disposed rigid reinforcing rods in said concrete at spaced intervals, before said concrete hardens, said reinforcing rods having a bottom portion in said concrete and a portion above said concrete;

applying liquid adhesive to a top portion of said concrete once it has cured;

securing a rigid expanded polystyrene block to the top of said concrete by placing the bottom thereof on said liquid adhesive and on the top portion of said concrete, said expanded polystyrene block having a plurality of vertically disposed openings spaced apart at substantially the same intervals as the spacing of said reinforcing rods whereby said openings, and said block also includes a horizontal depression formed in said block and extending substantially completely along the top thereof in liquid communication with said vertically disposed openings;

placing at least two rigid horizontal reinforcing rods along the length of said depression;

pouring concrete into said vertically disposed openings through said depressions;

pouring concrete into said depression whereby the result will be horizontal beam of concrete resting on and tied into a plurality of vertical concrete posts all surrounded by said expended polystyrene block;

adhesively securing an expanded polystyrene strip gasket over the top of the concrete in said depression;

adhesively securing a wooden top plate over said strip gasket; and, securing an EPS foam wedge over the top of said wooden top plate.

2. The method of claim 1 including placing a second set of vertically disposed reinforcing rods through said gasket, top plate, and foam wedge, and into said concrete in said depression, directly above the reinforcing rods in said vertically disposed openings.

3. The method of claim 2 including attaching an insulated roof to said walls wherein said roof will be sealingly engaged with said foam wedge.

4. The method of claim 1 including:

forming vertical cutouts at spaced intervals along the exterior of said block; introducing liquid adhesives into said vertical cutouts; and, placing fitted wood strips in said cutouts and nailing siding to said wood strips.

5. The method of claim 1 including the step of gluing drywall to the inside of said expanded polystyrene block.

* * * * *

UNITED STATES PATENT AND TRADEMARK OFFICE

CERTIFICATE OF CORRECTION

PATENT NO. : 4,823,534

DATED : April 25, 1989

INVENTOR(S) : Carl L. Hebinck

It is certified that error appears in the above-identified patent and that said Letters Patent is hereby corrected as shown below:

On the title page: Item [21] Application No. please delete 156,903 and insert therefor 156,906.

Signed and Sealed this

Twenty-sixth Day of October, 1993

*Attest:*

*Attesting Officer*

BRUCE LEHMAN

*Commissioner of Patents and Trademarks*